US009156150B2

(12) United States Patent
Wang

(10) Patent No.: US 9,156,150 B2
(45) Date of Patent: Oct. 13, 2015

(54) SNAP RING PLIERS

(71) Applicant: Yuan yu Wang, Taichung (TW)

(72) Inventor: Yuan yu Wang, Taichung (TW)

( * ) Notice: Subject to any disclaimer, the term of this patent is extended or adjusted under 35 U.S.C. 154(b) by 306 days.

(21) Appl. No.: 13/938,251

(22) Filed: Jul. 10, 2013

(65) Prior Publication Data

US 2015/0013128 A1 Jan. 15, 2015

(51) Int. Cl.

| | |
|---|---|
| ***B25B 27/30*** | (2006.01) |
| ***B25B 27/20*** | (2006.01) |
| ***B25B 7/14*** | (2006.01) |
| ***B25B 7/08*** | (2006.01) |

(52) U.S. Cl.

CPC ..... *B25B 27/205* (2013.01); *B25B 7/08* (2013.01); *B25B 7/14* (2013.01); *Y10T 29/5363* (2015.01)

(58) Field of Classification Search

CPC ..... B25B 13/08; B25B 13/58; B25B 23/00; B25B 23/0085; B25B 13/36; B25B 13/5083; B25B 13/54; B25B 7/14; B25B 7/16; B25B 7/18; B25B 27/20; B25B 27/30

USPC ..... 29/229

See application file for complete search history.

(56) References Cited

U.S. PATENT DOCUMENTS

| | | | | |
|---|---|---|---|---|
| 2,923,444 | A * | 2/1960 | Orendorff | 222/410 |
| 2,959,993 | A * | 11/1960 | Freimark | 72/409.01 |
| 3,041,712 | A * | 7/1962 | Wurzel | 29/229 |
| 3,263,534 | A * | 8/1966 | Webbeking | 81/143 |
| 3,564,694 | A * | 2/1971 | Millheiser | 29/229 |
| 4,280,265 | A * | 7/1981 | Murphy | 29/229 |
| 4,683,620 | A * | 8/1987 | Valsecchi et al. | 24/71 SK |
| 6,481,310 | B2 * | 11/2002 | Janeczko et al. | 74/493 |
| 8,347,471 | B2 | 1/2013 | Wang | |
| 8,763,210 | B2 * | 7/2014 | Vincent et al. | 24/68 SK |
| 2006/0208407 | A1 * | 9/2006 | Wang | 269/6 |
| 2012/0174361 | A1 * | 7/2012 | Wang | 29/229 |
| 2013/0091674 | A1 * | 4/2013 | Chen | 24/68 SK |

* cited by examiner

*Primary Examiner* — Joseph J Hail
*Assistant Examiner* — J. Stephen Taylor

(57) ABSTRACT

The present invention relates to a snap ring pliers. As to the entire structure of the present invention, a lock member is simply turned to control gripping members to hold or release deformation of a snap ring. The lock member is turned for a stop of a limit member to hold against the upper surface of an elastic plate to block a hook portion from moving upward, so that the elastic plate can be made with a thinner plate. The hook portion is flexibly held by teeth of a ratchet rail. A lower protrusion of the elastic plate is held by an upper protrusion of the lock member with less resistance. This enhances the lock member to be turned in a labor-saving or flexible way.

3 Claims, 12 Drawing Sheets

SNAP RING PLIERS

BACKGROUND OF THE INVENTION

1. Field of the Invention

The present invention relates to snap ring pliers, and more particularly to snap ring pliers provided with a lock member which is operated in a labor-saving flexible way.

2. Description of the Prior Art

A snap ring is shaped as C and used to retain elements (e.g., bearings or shafts) within a bore. The snap ring has certain elasticity itself to be expanded or contracted. In order to install the snap ring on a desired article, special pliers are required to contract or expand the snap ring so as to position the span ring on a workpiece. For conventional snap ring pliers, the user grips two handles of the pliers to operate the snap ring. The gripping members of the jaws of the pliers are opened or closed to expand or contract the snap ring. The operation is controlled by the user's feeling. That is to say, when the snap ring is contracted or expanded to a predetermined deformation, the user has to control the exerting force exactly. When the operation is inappropriate, the snap ring may fall before positioned. The stored elastic energy of the deformed snap ring may cause the snap ring to fly, hit and hurt the individual who holds the snap ring pliers.

The applicant invented snap ring pliers, disclosed in Taiwan Utility Model Reg. No. M409924 (U.S. Pat. No. 8,347,471), overcome the shortcomings of the conventional snap ring appliers. The snap ring pliers are operated conveniently and save for use. For the hook portion of the elastic plate to engage with the teeth stably and firm, a thick elastic plate is required.

However, the operation for the lock member to hold the elastic plate upward is laborious. If a thin elastic plate is used, the hook portion cannot be compressed or limited to cause the hook portion to bounce unexpectedly or disengagement. Thus, the need for improvement still exists.

SUMMARY OF THE INVENTION

The primary object of the present invention is to provide a snap ring pliers comprising a pair of first and second levers which are pivotally secured together at a fulcrum. The first lever comprises a first jaw and a first handle. The second lever comprises a second jaw and a second handle. A first gripping member is projected out of an open end of the first jaw. A second gripping member is projected out of an open end of the second jaw. A torsion spring is provided between the first and second handles adjacent to the fulcrum. The first and second handles are operated to open or close the first and second gripping members by means of the torsion spring.

A curved ratchet rack has one end fixedly secured to an open end of the second handle and the other end disposed proximate to an open end of the first handle. A sliding member fixedly secured to an open end of the first handle and adapted to ride on the ratchet rack. The sliding member comprises an internal channel therethrough with the other end of the ratchet rack disposed therein in an inoperative position of the pliers. The ratchet rack can move through the channel in an operative position. The sliding member has an opening at a front end thereof and a projection at a rear thereof. The projection is pivotally connected with a movable lock member, and an elastic plate is fixed on the projection. The lock member has an upper protrusion to lift the elastic plate obliquely. One end of the elastic plate is fixed on the projection, and the other end of the elastic plate is bent inward to form a hook portion extending through the opening to the channel. One side of the lock member is provided with a limit member. The limit member has a flat board extending on the surface of the lock member. The inner surface of the flat board is formed with a lower protruding stop which is away from the elastic plate. The elastic plate has a lower protrusion corresponding to the upper protrusion of the lock member. The upper protrusion holds against the lower protrusion in the inoperative position. When the upper protrusion of the lock member holds against the lower protrusion of the elastic plate to lift the elastic plate, the hook portion is moved upward and the ratchet rack is not contact with teeth. The gripping members of the jaws of the first and second lever can be operated freely by the handles to lock a snap ring between a maximum angle and a minimum angle. After the gripping members grip the snap ring, the lock member is turned for the upper protrusion to disengage from the lower protrusion of the elastic plate. The hook portion descends to enter the channel and get contact with the teeth of the ratchet rail. The stop of the limit member is moved to the upper surface of the elastic plate to block the hook portion from moving upward so that the distal end of the hook portion mates with the teeth stably. Next, the user may continuously exert force to grip the handles of the first and second levers so as to flexibly deform (i.e., expand) the snap ring. During the angle between the handles is gradually reduced, the ratchet rail is moved inward toward the channel of the sliding member. The hook portion of the elastic plate is compressed and deformed by the slope of a tooth of the ratchet rail to reduce its bent angle and then restore to be engaged with the stop surface of the next tooth, such that the ratchet rail is moved step-by-step in the channel. The snap ring is deformed by the gripping members. The user may stop exerting force on the handles when the snap ring is firmly held by the gripping members to lock or unlock the snap ring on a workpiece. After finishing the working, the lock member is turned again for the stop of the limit member to disengage from the upper surface of the elastic plate to release the hook portion. The upper protrusion holds against the lower protrusion of the plastic plate to lift the elastic plate obliquely, and the hook portion is moved upward to disengage from the teeth of the ratchet rail. The ratchet rail is released to slide backward in the channel. The first and second levers are biased by the torsion spring to return. The snap ring is restored to its original shape before deformation, so that the gripping members can disengage from the snap ring smoothly. According to the entire structure of the present invention, the lock member is simply turned to control the gripping members to hold or release deformation of the snap ring. The lock member is turned for the stop of the limit member to hold against the upper surface of the elastic plate to block the hook portion from moving upward, so that the elastic plate can be made with a thinner plate. The hook portion is flexibly held by the teeth of the ratchet rail. The lower protrusion of the elastic plate is held by the upper protrusion of the lock member with less resistance. This enhances the lock member to be turned in a labor-saving or flexible way.

Another object of the present invention is to provide a snap ring pliers, wherein one end of the elastic plate is shaped as C to form a fixing portion. The fixing portion is fixed on the projection. Through the C-shaped end, the elastic plate is more flexible for the upper protrusion of the lock member to lift or to disengage from the lower protrusion of the elastic plate smoothly. The C-shaped end of the elastic plate has a [-shaped notch for a portion of the fixing portion to be exposed, so that the fixing portion is fixed on the projection with a fastener inserting through the notch.

The above and other objects, features and advantages of the invention will become apparent from the following detailed description taken with the accompanying drawings.

DETAILED DESCRIPTION OF THE INVENTION

Figure 1:
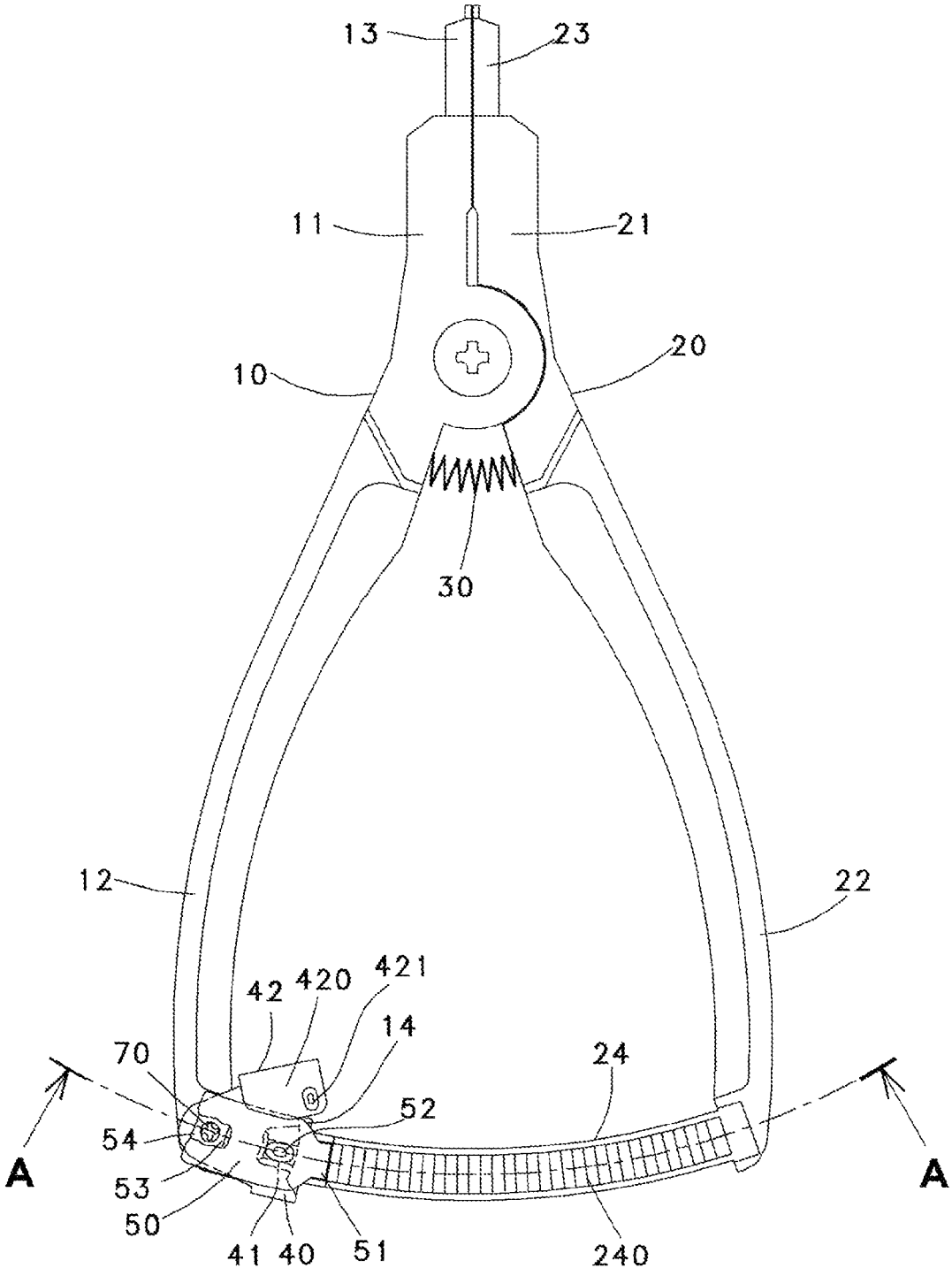
FIG. 1 is a side elevation of ratchet pliers for external type of snap ring according to a first preferred embodiment of the invention, the pliers being locked in an inoperative position with the handle ends being separated to a maximum distance.
Figure 2:
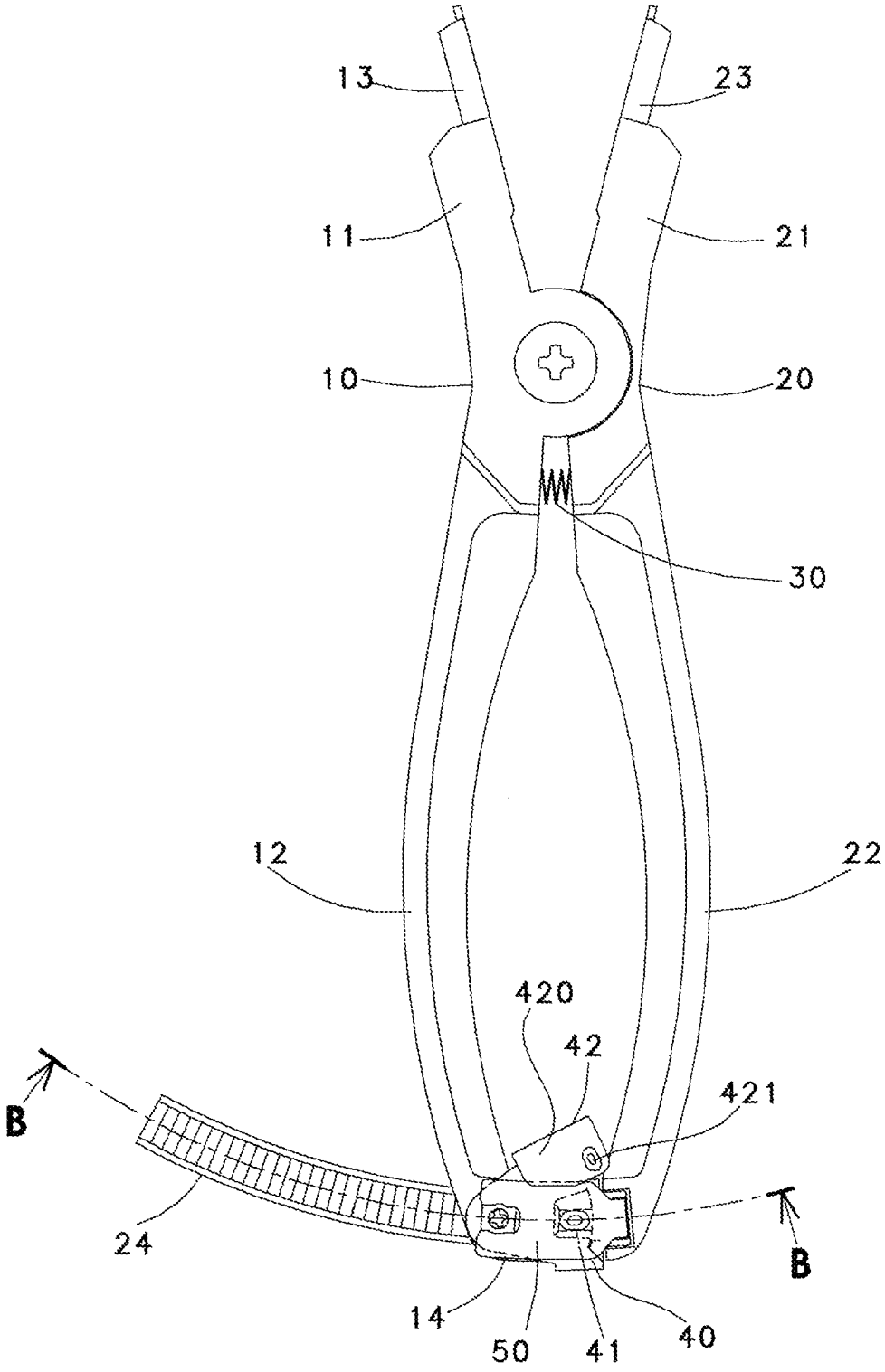
FIG. 2 is a view similar to FIG. 1 where the handles ends being pivoted to be proximate each other as the handles being pushed toward each other by the force exerted by the hand.

Referring to FIGS. 1 to 14, the snap ring pliers in accordance with a first preferred embodiment of the invention comprises the following components as discussed in detail below.

A pair of first and second levers 10, 20 is pivotally secured together at a fulcrum. The first lever 10 comprises a first jaw 11 and a first handle 12. The second lever 20 comprises a second jaw 21 and a second handle 22. A first gripping member 13 is projected out of an open end of the first jaw 11. A second gripping member 23 is projected out of an open end of the second jaw 21. A torsion spring 30 is provided between the first and second handles 12, 22 adjacent to the fulcrum. The first and second handles 12, 22 are operated to open or close the first and second gripping members 13, 23 by means of the torsion spring 30.

A curved ratchet rack 24 has one end fixedly secured to an open end of the second handle 22 and the other end disposed proximate to an open end of the first handle 12. A sliding member 14 is fixedly secured to an open end of the first handle 12 and adapted to ride on the ratchet rack 24 as detailed below. The sliding member 14 comprises an internal channel 15 therethrough with the other end of the ratchet rack 24 disposed therein in an inoperative position of the pliers. The ratchet rack 24 can move through the channel 15 in an operative position. The sliding member 14 has an opening 16 at a front end thereof and a projection 17 at a rear thereof. The projection 17 is pivotally connected with a movable lock member 40, and an elastic plate 50 is fixed on the projection 17. The lock member 40 has an upper protrusion 41 to lift the elastic plate 50 obliquely. One end of the elastic plate 50 is fixed on the projection 17, and the other end of the elastic plate 50 is bent inward to form a hook portion 51 extending through the opening 16 to the channel 15. One side of the lock member 40 is provided with a limit member 42. The limit member 42 has a flat board 420 extending on the surface of the lock member 40. The inner surface of the flat board 420 is formed with a lower protruding stop 421 which is away from the elastic plate 50. The elastic plate 50 has a lower protrusion 52 corresponding to the upper protrusion 41 of the lock member 40. The upper protrusion 41 holds against the lower protrusion 52 in the inoperative position. When upper protrusion 41 of the lock member 40 holds against the lower protrusion 52 of the elastic plate 50 to lift the elastic plate 50, the hook portion 51 is moved upward and the ratchet rack 24 is not contact with the teeth 240. The gripping members 13, 23 of the jaws 11, 21 of the first and second lever 10, 20 can be operated freely by the handles 12, 22 to lock a snap ring between a maximum angle and a minimum angle.

Figure 5:
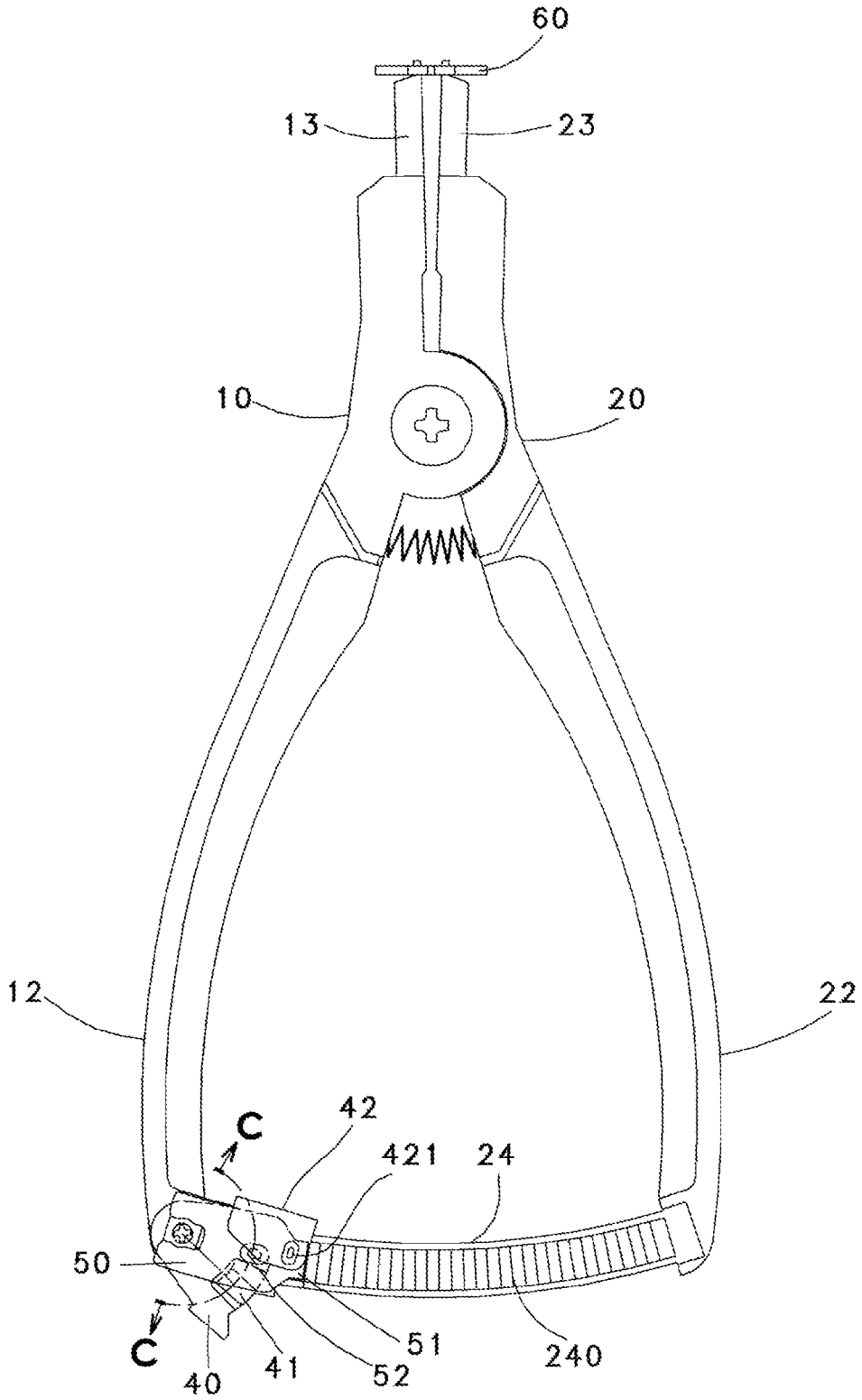
FIG. 5 is a view similar to FIG. 1 with a snap ring being gripped by the gripping members and the lock member being pivoted to unlock the sliding member.
Figure 6:
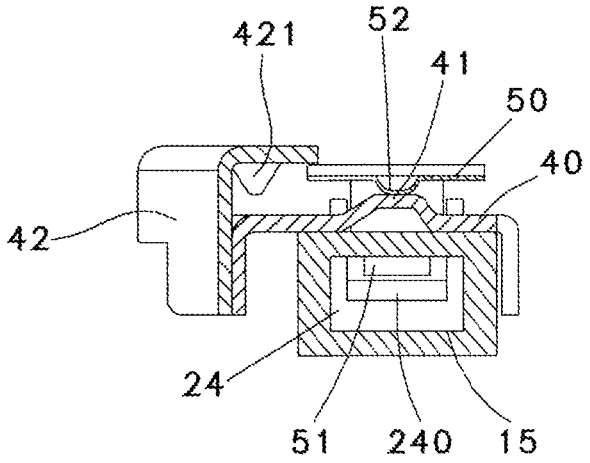
FIG. 6 is a sectional view showing the locked state of the lock member in the inoperative position of the pliers.
Figure 7:
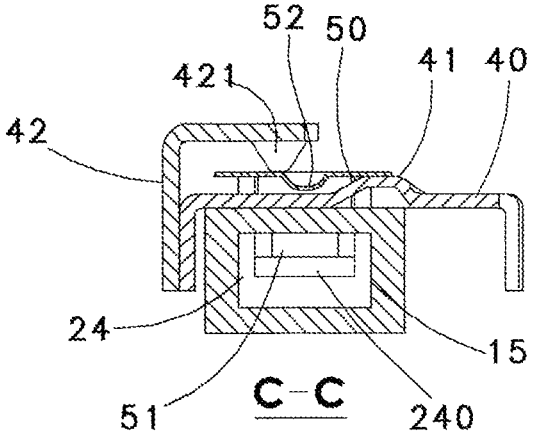
FIG. 7 is a sectional view taken along line C-C of FIG. 5 showing the unlocked state of the lock member where the sliding member is ready to ride along the ratchet rack in an operative position of the pliers.

As shown in FIGS. 5, 6 and 7, after the gripping members 13, 23 gripping the snap ring 60, the lock member 40 is turned for the upper protrusion 41 to disengage from the lower protrusion 52 of the elastic plate 50. The hook portion 51 descends to enter the channel 15 and get contact with the teeth 240 of the ratchet rail 24. The stop 421 of the limit member 42 is moved to the upper surface of the elastic plate 50 to block the hook portion 51 from moving upward so that the distal end of the hook portion 51 mates with the teeth 240 stably. Next, the user may continuously exert force to grip the handles 12, 22 of the first and second levers 10, 20 so as to flexibly deform (i.e., expand) the snap ring 60.

Figure 9:
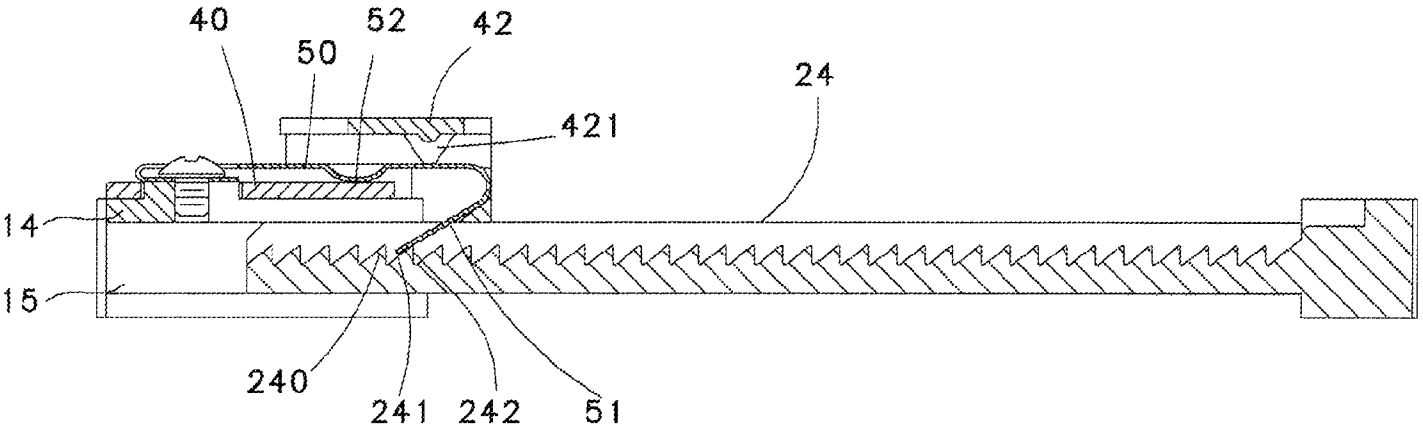
FIG. 9 is a view similar to FIG. 8 where the ratchet rack is moved leftward with the sliding member riding thereon by passing the teeth.
Figure 10:
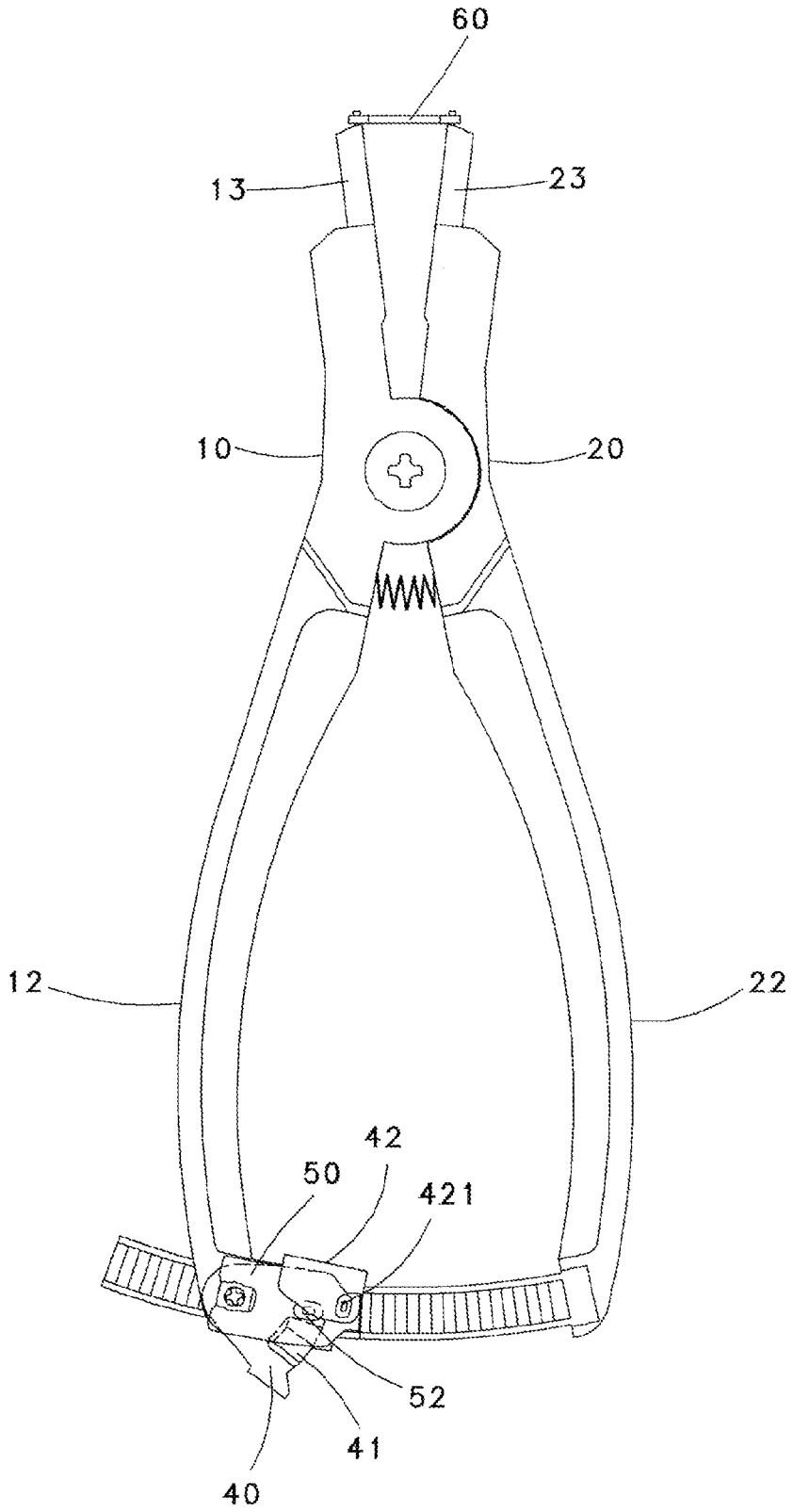
FIG. 10 is a view similar to FIG. 5 showing the snap ring being expanded during the movement of the sliding member along the ratchet rack.
Figure 11:
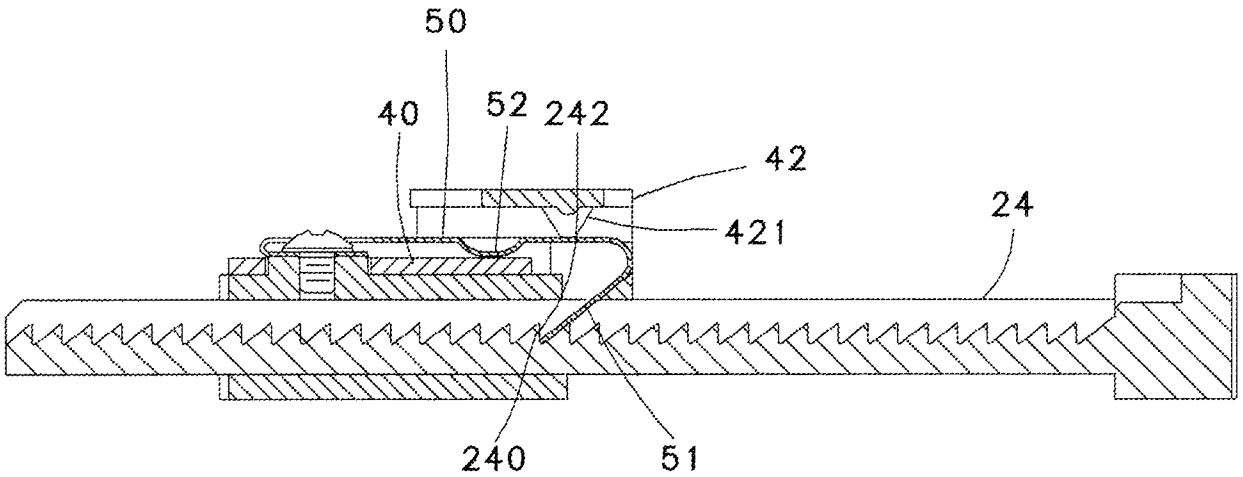
FIG. 11 is a view similar to FIG. 8 showing the hook portion being locked by the depression between the teeth at the end of the expanding operation of the snap ring.

During the angle between the handles 12, 22 is gradually reduced, as shown in FIG. 9, the ratchet rail 24 is moved inward toward the channel 15 of the sliding member 14. The hook portion 51 of the elastic plate 50 is compressed and deformed by the slope 241 of a tooth 240 of the ratchet rail 24 to reduce its bent angle and then restore to be engaged with the stop surface 242 of the next tooth 240, such that the ratchet rail 24 is moved step-by-step in the channel 15. As shown in FIG. 10, the snap ring 60 is deformed by the gripping members 13, 23. As shown in FIGS. 10 and 11, the user may stop exerting force on the handles 12, 22 when the snap ring 60 is firmly held by the gripping members 13, 23 to lock or unlock the snap ring 60 on a workpiece.

Figure 12:
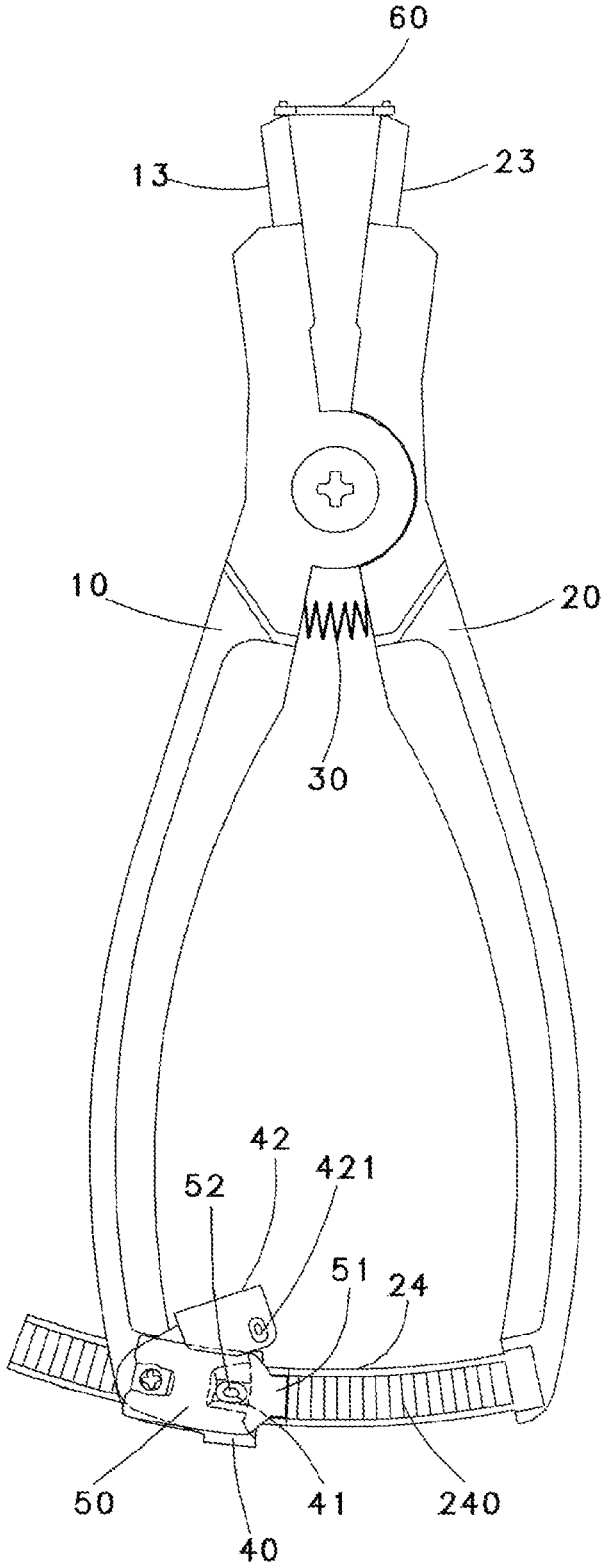
FIG. 12 is a view similar to FIG. 10 showing the pliers in a state corresponding to FIG. 11.
Figure 13:
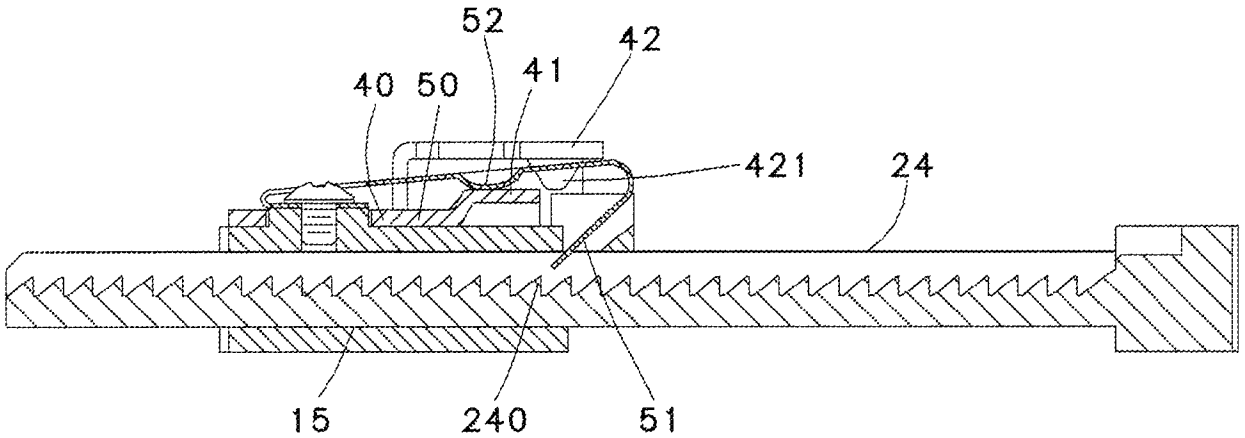
FIG. 13 is a view similar to FIG. 3 showing the sliding member being locked again by the lock member as a step for releasing the snap ring.

After finishing the working, as shown in FIGS. 12 and 13, the lock member 40 is turned again for the stop 421 of the limit member 42 to disengage from the upper surface of the elastic plate 50 to release the hook portion 51. The upper protrusion 41 holds against the lower protrusion 52 of the plastic plate 50 to lift the elastic plate 50 obliquely, and the hook portion 51 is moved upward to disengage from the teeth 240 of the ratchet rail 24. The ratchet rail 24 is released to slide backward in the channel 15. The first and second levers 10, 20 are biased by the torsion spring 30 to return.

Figure 8:
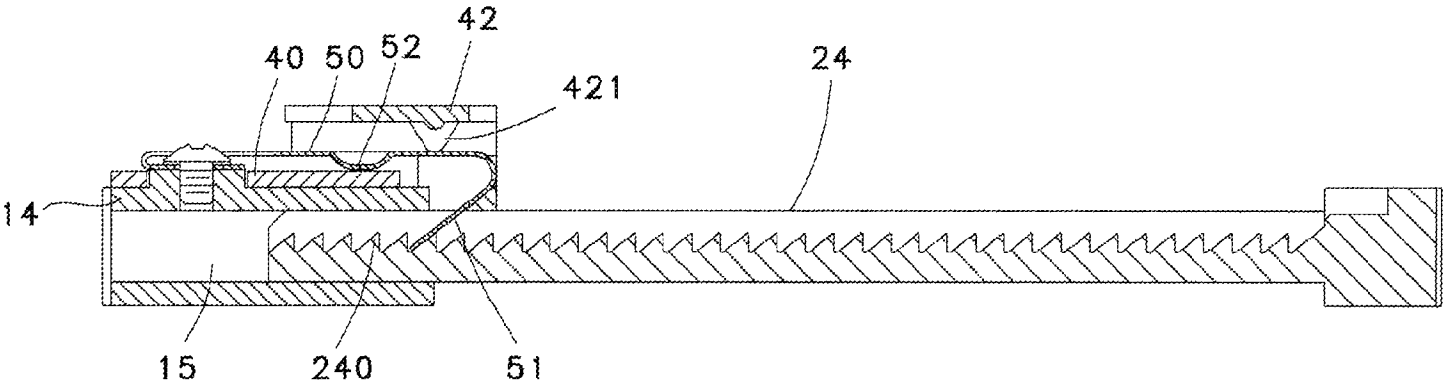
FIG. 8 is a longitudinal sectional view of the sliding member and the ratchet rack where the sliding member is unlocked.
Figure 14:
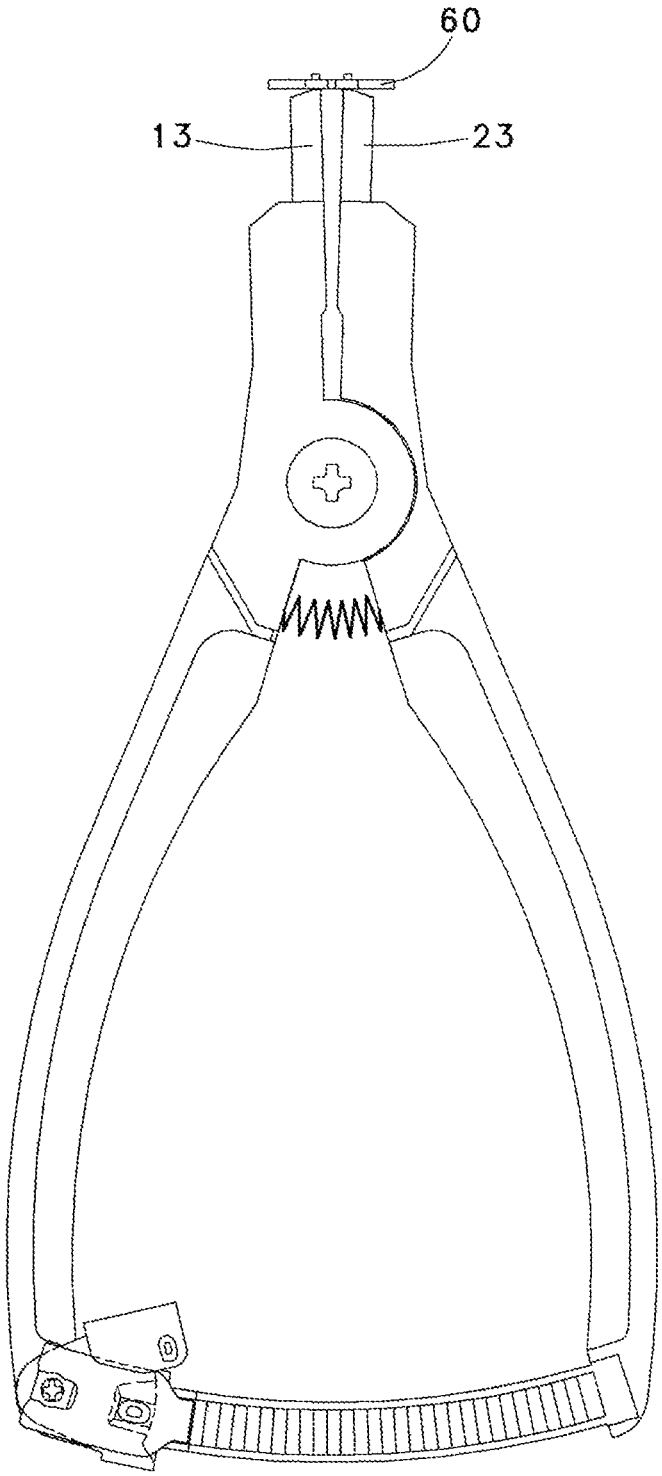
FIG. 14 is a view similar to FIG. 5 showing the locked sliding member and the contracted snap ring.

As shown in FIG. 14, the snap ring 60 is restored to its original shape before deformation, so that the gripping members 13, 23 can disengage from the snap ring 60 smoothly. According to the entire structure of the present invention, as shown in FIGS. 10, 11, 12, and 13, the lock member 40 is simply turned to control the gripping members 13, 23 to hold or release deformation of the snap ring 60. As shown in FIGS. 5, 7 and 8, the lock member 40 is turned for the stop 421 of the limit member 42 to hold against the upper surface of the elastic plate 50 to block the hook portion 51 from moving upward, so that the elastic plate 50 can be made with a thinner plate. As shown in FIGS. 8 and 9, the hook portion 51 is flexibly held by the teeth 240 of the ratchet rail 24. As shown in FIGS. 10, 11, 12, and 13, the lower protrusion 52 of the elastic plate 50 is held by the upper protrusion 41 of the lock member 40 with less resistance. This enhances the lock member 40 to be turned in a labor-saving or flexible way.

Figure 3:
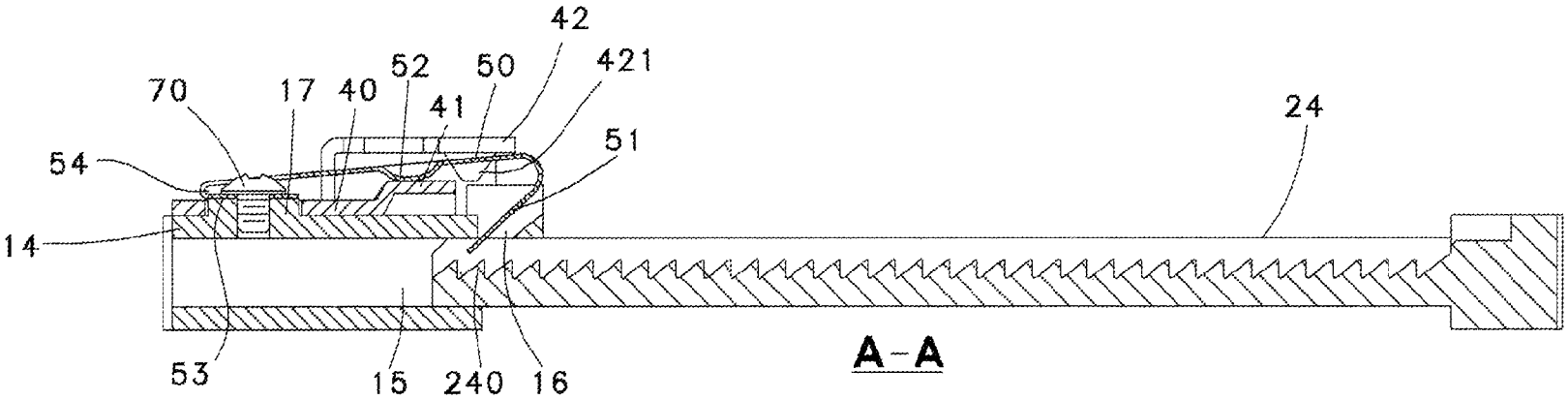
FIG. 3 is a sectional view taken along line A-A of FIG. 1.
Figure 4:
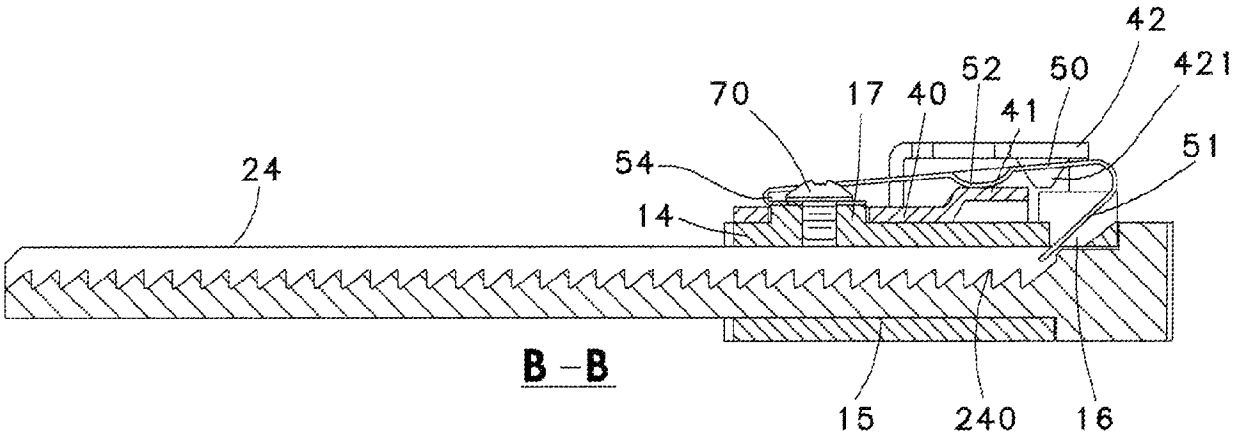
FIG. 4 is a sectional view taken along line B-B of FIG. 2.

According to the aforesaid embodiment, as shown in FIGS. 1 and 3, one end of the elastic plate is shaped like C to form a fixing portion 53. The fixing portion 53 is fixed on the projection 17. Through the C-shaped end, the elastic plate 50 is more flexible. As shown in FIGS. 10, 11, 12, and 13, the operation for the upper protrusion 41 of the lock member 40 to lift or to disengage from the lower protrusion 52 of the elastic plate 50 is smoother. As shown in FIGS. 1 and 3, the C-shaped end of the elastic plate 50 has a [-shaped notch 54 for a portion of the fixing portion 53 to be exposed, so that the fixing portion 53 is fixed on the projection 17 with a fastener 70 inserting through the notch 54.

According to the aforesaid embodiment, as shown in FIGS. 1 and 3, the jaws 11, 21 of the first and second levers 10, 20 are pivotally connected side by side. As shown in FIG. 5, the gripping members 13, 23 of the jaws 11, 21 are expanded by gripping the handles 12, 22 to expand the snap ring 60 in an internal-type.

Figure 15:
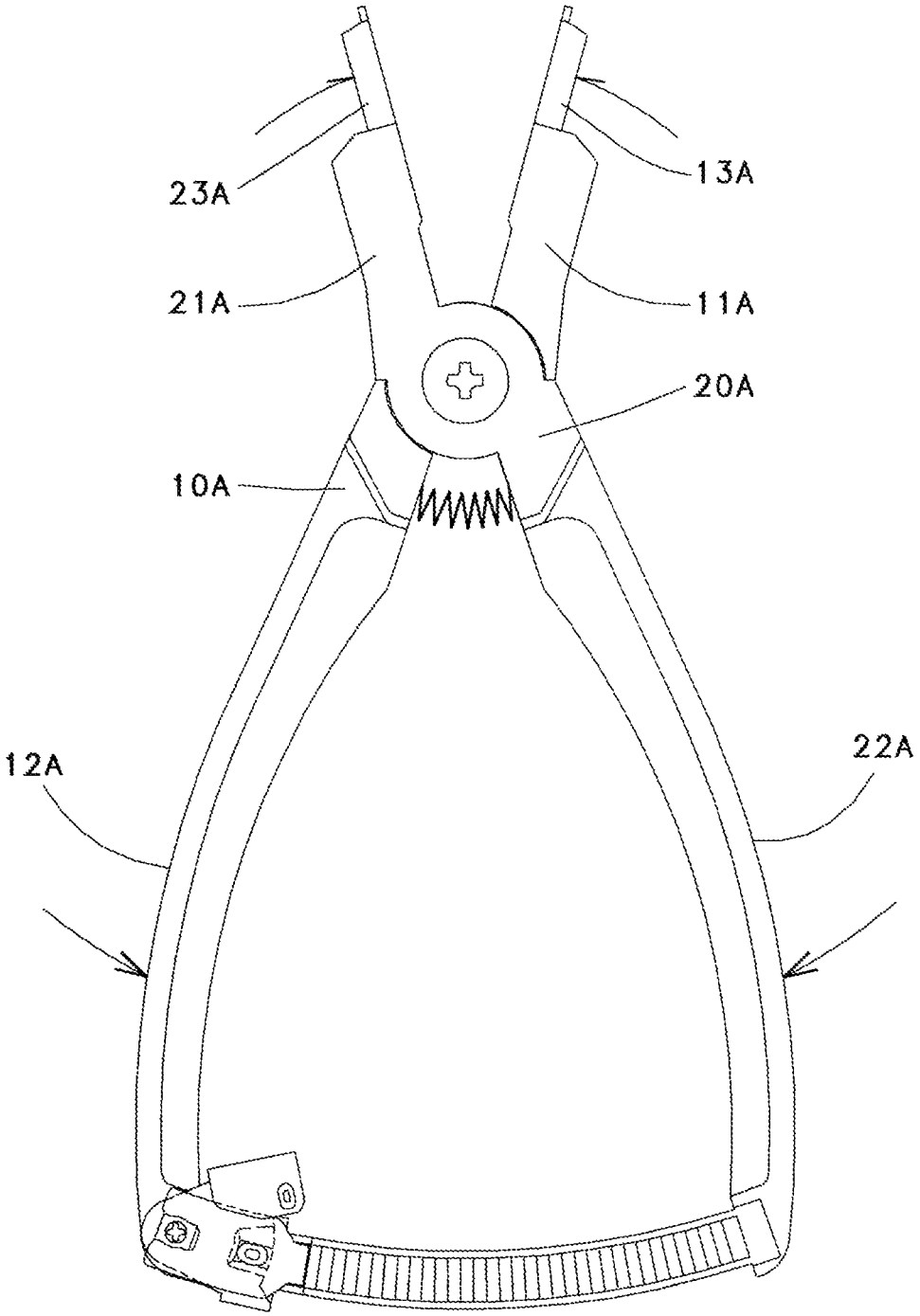
FIG. 15 is a side elevation of ratchet pliers for internal type of snap ring according to a second preferred embodiment of the invention, the pliers being locked in an inoperative position with the handle ends being separated to a maximum distance.

Referring to FIG. 15, ratchet pliers for internal type of snap ring according to a second preferred embodiment of the invention is shown. Jaws 11A, 21A of the first and second levers 10A, 20A are pivotally interconnected. The gripping members 13A, 23A of the jaws 11A, 21A are moved inward by gripping the handles 12A, 22A to contract the snap ring in an external-type.

While the invention has been described in terms of preferred embodiments, those skilled in the art will recognize that the invention can be practiced with modifications within the spirit and scope of the appended claims.

What is claimed is:

1. A snap ring pliers, comprising:

a first lever and a second lever which are pivotally secured together at a fulcrum, the first lever comprising a first jaw and a first handle, the second lever comprising a second jaw and a second handle, a first gripping member being projected out of an open end of the first jaw, a second gripping member being projected out of an open end of the second jaw, a torsion spring being provided between the first and second handles adjacent to the fulcrum, the first and second handles being operated to open or close the first and second gripping members by means of the torsion spring;

a curved ratchet rack having one end fixedly secured to an open end of the second handle and the other end disposed proximate to an open end of the first handle when in an inoperative position, a sliding member being fixedly secured to an open end of the first handle and adapted to ride on the ratchet rack;

the sliding member comprising an internal channel therethrough with the other end of the ratchet rack disposed therein, the ratchet rack being able to move through the channel;

the sliding member having an opening at a front end thereof and a projection at a rear thereof, with a movable lock member being pivotally connected to the projection, an elastic plate being fixed on the projection;

the lock member having an upper protrusion to lift the elastic plate obliquely, one end of the elastic plate being fixed on the projection and the other end of the elastic plate being bent inward to form a hook portion extending through the opening to the channel; and one side of the lock member being provided with a limit member, the limit member having a flat board extending above and parallel to an upper surface of the lock member, a lower surface of the flat board being formed with a lower protruding stop which is away from the elastic plate when the lock member is in an unlocked position, the elastic plate having a lower protrusion corresponding to the upper protrusion of the lock member, the upper protrusion holding against the lower protrusion when the lock member is in the unlocked position.

2. The snap ring pliers as claimed in claim 1, wherein one end of the elastic plate is C-shaped to form a fixing portion, the fixing portion being fixed on the projection, through the C-shaped end, the elastic plate being flexible for the upper protrusion of the lock member to lift or to disengage from the lower protrusion of the elastic plate smoothly.

3. The snap ring pliers as claimed in claim 2, wherein the C-shaped end of the elastic plate has a [-shaped notch for a portion of the fixing portion to be exposed, the fixing portion being fixed on the projection with a fastener inserted through the notch.

* * * * *